United States Patent [19]

Thoma

[11] 4,105,002

[45] Aug. 8, 1978

[54] PNEUMATIC CONTROLLER FOR AN INJECTION PUMP, ESPECIALLY FOR DIESEL ENGINES

[75] Inventor: Frank Thoma, Stuttgart, Germany

[73] Assignee: Daimler-Benz Aktiengesellschaft, Germany

[21] Appl. No.: 650,067

[22] Filed: Jan. 19, 1976

[30] Foreign Application Priority Data

Jan. 22, 1975 [DE] Fed. Rep. of Germany ..... 2502387

[51] Int. Cl.[2] ..... F02D 1/14

[52] U.S. Cl. ..... 123/140 MP

[58] Field of Search ..... 123/140 MP

[56] References Cited

U.S. PATENT DOCUMENTS

| | | | |
|---|---|---|---|
| 2,093,984 | 9/1937 | Schweizer | 123/140 MP |
| 2,160,109 | 5/1939 | Schweizer | 123/140 MP |

*Primary Examiner*—Gerald A. Michalsky

*Attorney, Agent, or Firm*—Craig & Antonelli

[57] ABSTRACT

A pneumatic controller for an injection pump of an internal combustion engine which varies the quantity of injected fuel and which includes a pneumatic actuating device acting on the quantity adjusting member of the injection pump which in the presence of a vacuum displaces the quantity adjusting member in the direction toward smaller injected quantities, and a force storage device also acting on the quantity adjusting member; a drive lever actuatable at will is provided which is operatively connected with the controller for selectively varying the torque of the engine; additional means are also provided in the controller which produce a vacuum corresponding to the deflection of the drive lever from its normal rest position while a connection exists between the additional means and the pneumatic actuating device to transmit to the latter the vacuum produced in the former.

34 Claims, 5 Drawing Figures

FIG. 1
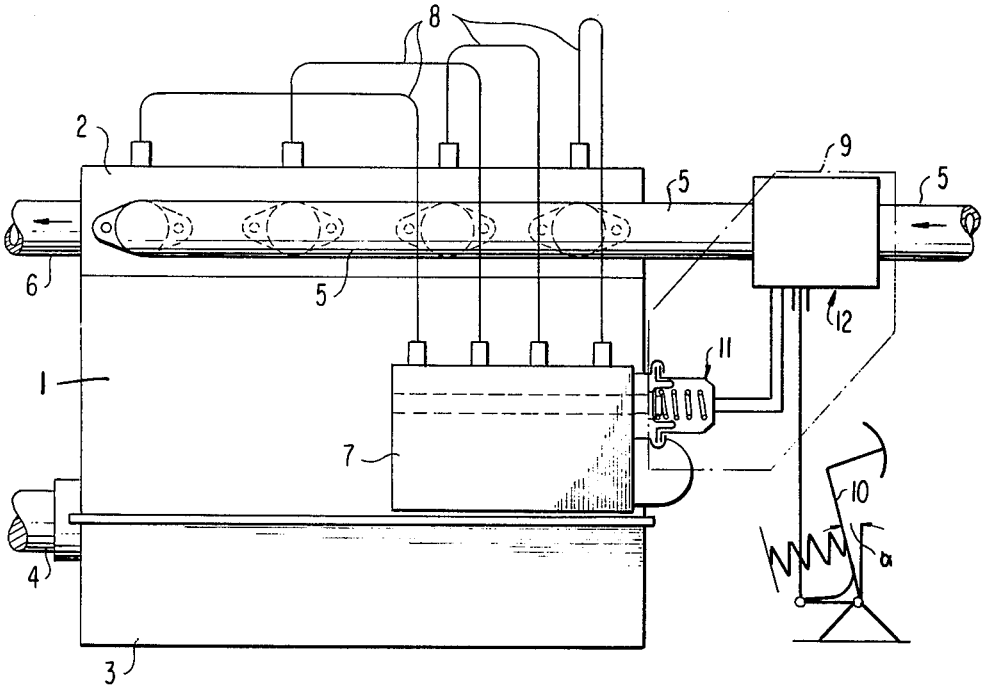
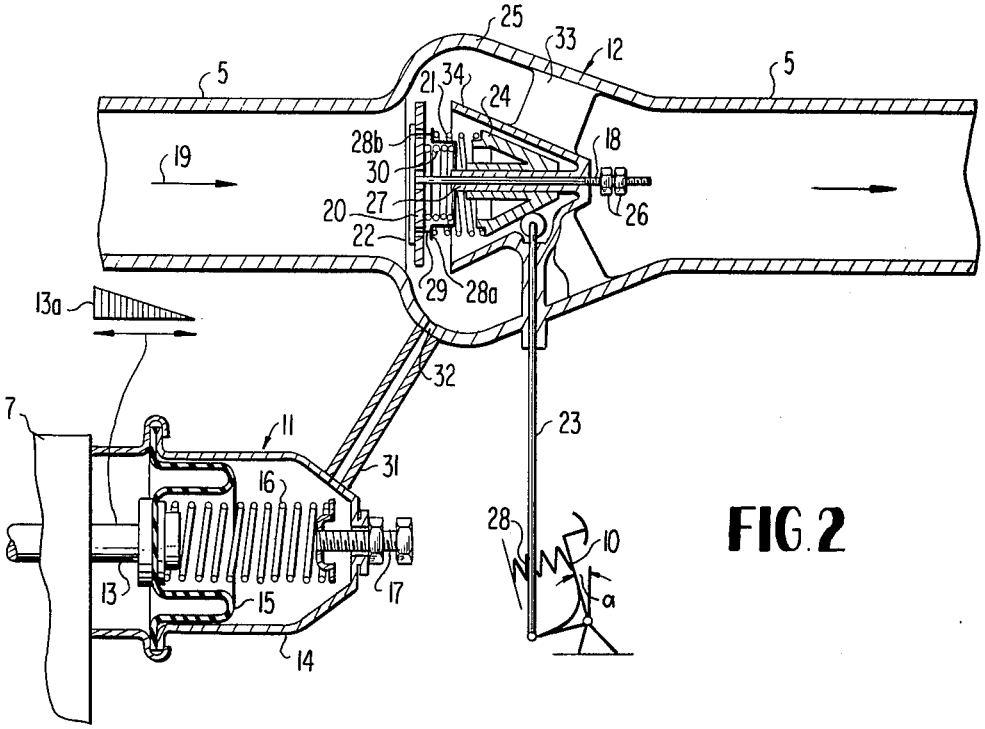
FIG. 2

FIG.3
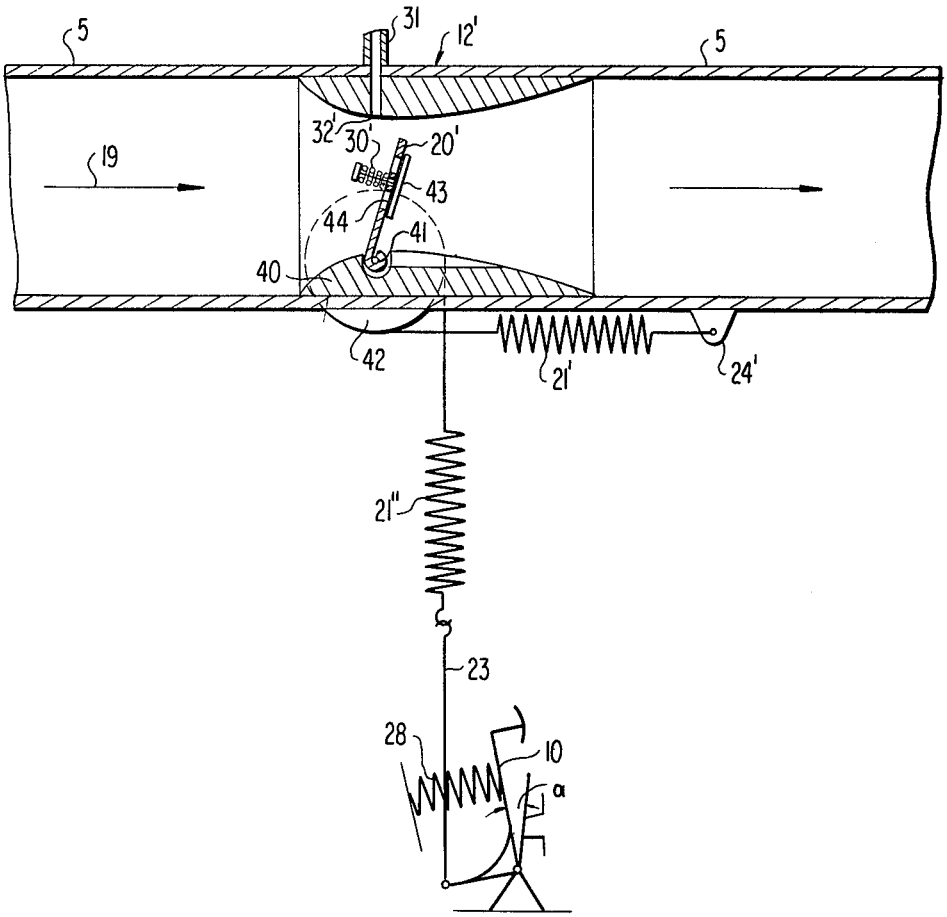
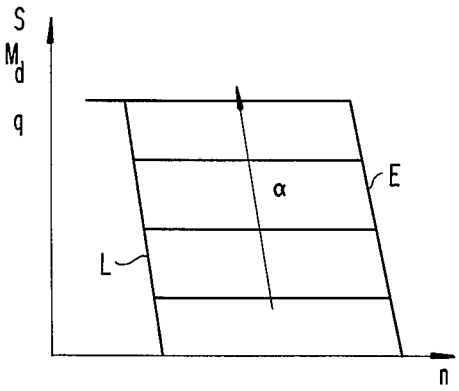
FIG.4
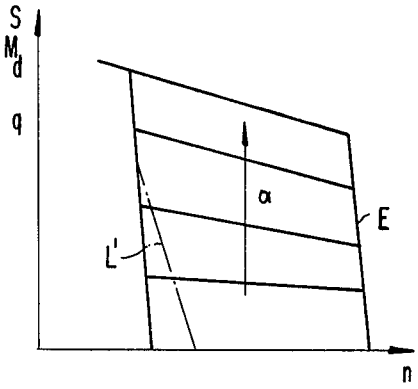
FIG.5

PNEUMATIC CONTROLLER FOR AN INJECTION PUMP, ESPECIALLY FOR DIESEL ENGINES

The present invention relates to a pneumatic controller for an injection pump, varying the injection quantity, of an internal combustion engine, especially of a Diesel motor vehicle engine, with a pneumatic working device at least indirectly acting on the quantity adjusting member of the injection pump, especially with a diaphragm piston, which displaces the quantity adjusting member in case of vacuum actuation in the direction toward smaller injection quantities as well as with at least one force storage device also acting at least indirectly on the quantity adjusting member—and more particularly in the sense of an injection quantity increase—especially a spring (injection-quantity force-storage device), and further with a selectively actuatable lever (drive lever) at least indirectly operatively connected with the controller.

Known controllers of this type (compare, for example, German Offenlegungsschrift No. 2,350,224) are less expensive as compared to centrifugal controllers because they are more simple in construction; they are consequently used above all for such Diesel engines as are to be installed into passenger motor vehicles. It is disadvantageous with the prior art pneumatic controllers that the lines of identical drive lever position in the performance graph in a torque/rotational speed diagram drop off very steeply. This behavior of the controller has in practice the effect such that the engine seeks to maintain a velocity or rotational speed corresponding to the drive lever position independently of the engine load. However, such a behavior entails a relatively strong torque change of the engine with only slight positional changes at the drive lever. This has as a consequence with larger engines a hard, jerk-like manner of operation. Additionally, with the use of automatic transmissions, a torque-analogous signal required for the control of the transmission cannot be obtained in a simple manner, for example, cannot be obtained by pick-up of the position of the drive lever.

It is the aim of the present invention to eliminate these disadvantages and to provide above all a pneumatic controller which exhibits essentially a filling or fuel injection controller characteristic, i.e., in which essentially the injection quantities or the engine torques are prescribed by the drive lever positions.

This task is solved according to the present invention in that means are provided in the controller which in accordance with the deflection of the drive lever or drive pedal from its rest position produce a correspondingly large vacuum and in that a pressure-compensating connection is arranged between the vacuum connection of the means and the pneumatic working device acting on the quantity-adjusting member. Appropriately, the means supplying the vacuum dependent on the drive lever position consist of a variable throttling device arranged in the air suction line of the internal combustion engine and at least indirectly connected with the drive lever, whereby the movable part effective in a throttling manner (throttle plate) of the variable throttling device is constructed and supported in the throttling device in such a manner that in all positions of the throttle plate a force is exerted seeking to displace the throttle plate unequivocally in the direction toward the larger opening cross sections by the flow passing through the throttling device by reason of a dynamic pressure influence, that additionally a force storage means seeking to displace the throttle plate in the closing direction especially a spring (throttle main force storage means) is at least indirectly connected with its one end with the throttle plate, and that the drive lever is indirectly connected with the other end of the throttle main force storage means in such a manner that as a result of a movement of the drive lever in the direction toward a larger power output of the internal combustion engine, the force effectively exerted by the throttle main force storage means on the throttle plate is reduced and vice versa.

Consequently, the cross-sectional control which will be found in the prior art pneumatic controllers, for producing the vacuum responsible for injection quantities, is replaced according to the present invention by a pressure control. This means the vacuum responsible for the injection quantity is produced by the prestress of a spring or the like, effective in the closing direction, on a throttle plate. The suction pipe-vacuum is accordingly nearly independent of the engine rotational speed and is determined only by the drive lever position. With the prior art controller, in contrast thereto, the drive lever position determined the throttle cross section non-yieldingly so that the suction pipe vacuum, in addition to being dependent on the drive lever position, was additionally dependent also very strongly on the engine rotational speed.

By reason of the construction of the controller according to the present invention, the lines of identical drive lever position extend very flat in a torque/rotational speed diagram, i.e., the engine torque and the injection quantity is far-reachingly determined alone by the drive lever position over the variable rotational speed range of the engine. During load fluctuations, the engine rotational speed changes strongly—insofar as one does not counteract or countercontrol by means of the drive lever. This soft rotational speed behavior, however, is precisely desirable for a jerk-free driving operation; additionally, with the use of automatically shifted transmissions, the rotational speed signal required for the automatic shifting mechanism of the transmission can be obtained in a simple manner by pick-up of the drive lever position.

In order to prevent a stalling of the engine with a fully extended drive lever in the direction toward idling, provision is made that the smallest possible opening cross section of the throttling device is determined by an adjustable abutment arranged in the movement range of the throttle plate or of a member kinematically unequivocally coupled therewith. Owing to this abutment, the smallest possible throttle cross section and therewith the idling of the internal combustion engine is determined. It is desirable that the engine in the idling position of the drive lever does not drop to a lowermost rotational speed but assumes a predetermined rotational speed-load-characteristic line (idling characteristic line). This characteristic line above the lowest possible idling rotational speed is desirable in order that the engine can be loaded without difficulty with auxiliary aggregates or with other variable power-consuming loads, for example, with air-conditioning compressors or with a cooling fan adapted to be engaged and disengaged, or that, for example, with a hydrodynamic force transmission or with hydraulic auxiliary drives, a completely satisfactory idling of the engine is assured also with a cold hydraulic oil without requiring the driver to intercede at the drive lever.

In order that the drive lever need not be forcibly displaced in both displacement directions—namely in the direction toward "idling" and in the direction toward "full"—and in order that a completely satisfactory change of the prestress of the pressure control by positional changes of the drive lever is nonetheless possible, it is appropriate if the drive lever is displaced by a spring force in the direction toward the position "idling" (return force) and that the return force effective at the point of engagement of the connection of the drive lever with the throttling device is made larger than the largest force of the throttle-main force storage device.

One aims at as flat as possible a configuration of the lines of identical drive lever position in the torque/rotational speed performance diagram. In order to achieve this, provision is made that the throttle main force storage device has a force/displacement characteristic which extends as flat as possible. The flat configuration of the force/displacement curve of the throttle main force storage device is responsible primarily for the configuration of the lines of identical drive lever positions.

For purposes of avoiding periodic rotational speed fluctuations during idling, a less steep configuration of the idling characteristic curve in the torque/rotational speed performance graph is desirable above a predetermined rotational speed than is attainable by the rigid abutment of the throttle plate at the idling abutment in the drive lever position "idling". This requirement can be fulfilled according to the present invention in two ways. More particularly, on the one hand, it can be achieved in that a further force storage device, preferably a spring (throttle-idling-force storage device) is arranged at the pneumatic filling or injection controller according to the present invention in the force transmission between the throttle-main force storage device and the throttle plate downstream of the throttle-main force storage device, as viewed in the direction of force transmission, in such a manner that the force transmission passes sequentially through the one and then through the other force storage device, and in that the end of the throttle main force storage device facing the throttle plate or a part rigidly connected therewith thereby cooperates directly with the aforementioned abutment. The other type of the idling rotational speed-increase and a flattening of the idling characteristic curve consists in that a part (idling plate) of the throttle plate exposed to the dynamic pressure of the air flow, is relatively movably supported with respect to the throttle plate in such a manner that it can be displaced by the dynamic pressure influence in the direction toward a cross-sectional enlargement and in that a spring (idling spring) seeking to displace the idling plate in the closing direction is arranged between the throttle plate and the idling plate. In both cases, it is appropriate for achieving a completely satisfactory effect of the idling rotational speed-increase and of the idling-curve flattening that the throttle-idling-force storage device and/or the idling spring has a considerably steeper force/displacement characteristic than the throttle-main force storage device.

At the upper end of the variable rotational speed range, a steep controlling down of the injection quantity is required for preventing a runaway of the engine in case of a sudden disappearance of the engine load. Such an end rotational speed control can be achieved in a simple manner by a constant maximum throttle cross section in the throttle device of the air suction line. In order now to be able to build up a vacuum which is still effective for the control rack displacement, with smallest possible flow losses, when the throttling device is fully opened with full engine output, it is appropriate if at least the pressure compensation connection, preferably, however,, also the throttle plate is arranged within the area of a cross-sectional constriction of the air suction line favorable from a streamlining point of view (end rotational speed-Venturi pipe). If such a Venturi insert is used, then the pressure-compensating connection must start within the area of its narrowest place. The Venturi constriction may be located within the area of the throttle plate or downstream thereof in the flow direction. The reasons to provide also the throttle plate within the area of the Venturi constriction, reside rather in a constructive simplification and structural shortening.

The combination of end rotational speed-Venturi-constriction and support or mounting of the throttle plate may take place appropriately in such a manner that the throttle plate is constructed as a plate axially movably supported in the air suction line, that the air suction line is enlarged onion-shaped within the area of the throttle plate (pipe enlargement) and in that a cone-like filler body extending approximately over the same area as the pipe enlargement is arranged in the flow shadow of the throttle plate approximately coaxially with the pipe enlargement in such a manner that the ring-shaped flow cross sections between the filler body and the inner wall of the pipe enlargement—starting from a minimum value disposed axially approximately at the place of the base of the filler body—increases to the normal line cross section in the direction of flow.

Accordingly, it is an object of the present invention to provide a pneumatic controller for an injection pump, especially for Diesel engines, which avoids by simple means the aforementioned shortcomings and drawbacks encountered in the prior art.

Another object of the present invention resides in a pneumatic controller for an injection pump which exhibits essentially a filling or fuel-injection control characteristic, in which the injection quantities and therewith the engine torques are essentially prescribed by the position of the drive pedal.

A further object of the present invention resides in a pneumatic controller for an injection pump, especially for Diesel engines of motor vehicles, in which the signal required for the control of the automatic shifting mechanism of the transmission can be obtained in a simple manner by pick-up of the position of the drive pedal.

Still a further object of the present invention resides in a pneumatic controller in which the suction pipe vacuum is nearly independent of the engine rotational speed and is determined only by the drive lever position.

Still another object of the present invention resides in a pneumatic controller for injection pumps, especially for Diesel engines, in which the lines of identical drive pedal position are very flat in the torque/rotational speed diagram.

Another object of the present invention resides in a pneumatic controller for injection pumps, especially for Diesel engines, which is not only simple in construction but effectively avoids stalling of the engine during idling, even if the engine is suddenly subjected to additional loads in the form of auxiliary aggregates, such as air-conditioning compressors or the like.

A still further object of the present invention resides in a pneumatic controller for injection pumps which not only utilizes relatively few, simple parts but permits a short construction thereof.

These and other objects, features, and advantages of the present invention will become more apparent from the following description when taken in connection with the accompanying drawing which shows, for purposes of illustration only, two embodiments in accordance with the present invention, and wherein:

FIG. 1 is a schematic side elevational view of the arrangement of a controller in accordance with the present invention in an internal combustion engine;

FIG. 2 is a somewhat schematic view, partly in cross section, of a controller in accordance with the present invention;

FIG. 3 is a schematic view, partly in cross section, of a modified embodiment of a controller in accordance with the present invention;

FIG. 4 is the ideal appearance of the performance diagram of a so-called filling or fuel-injection controller; and FIG. 5 is the performance diagram realizable with a controller in accordance with the present invention.

Referring now to the drawing wherein like reference numerals are used throughout the various views to designate like parts, and more particularly to FIG. 1, a Diesel engine with four in-line cylinders is illustrated in this figure which includes an engine block 1, a cylinder head 2, an oil pan or sump 3, an output shaft 4, an air suction line 5, an exhaust line 6, an injection pump 7, injection lines 8 and an injection pump controller 9 as well as a drive pedal 10 having an adjusting angle $\alpha$.

The controller 9 consists essentially of two parts, namely of an adjusting part generally designated by reference numeral 11 and of a pressure transmitter part generally designated by reference numeral 12. The adjusting part 11 acts on the quantity adjusting member 13 (FIG. 2), on the so-called control rack of the variable injection pump 7. More particularly, a pressure-tight roller diaphragm box 14 (FIG. 2) is retained coaxially to the control rack 13, in which a roller diaphragm 15 fastened to the end face of the control rack and to the diaphragm box 14, is arranged in a pressure-tight manner. The force of the adjustable spring 16 acts on the end face of the control rack 13 whereby the adjustable spring 16 can be adjusted by the adjusting bolt 17. The spring 16 is a force storage device whose force acting on the control rack 13 seeks to displace the same in the direction toward larger injection quantities. The coordination of the adjusting direction of the control rack 13 to the change of the injection quantity of the torque is indicated by the cross-hatched triangle 13a. The control rack 13 is pulled in the opposite direction by a vacuum prevailing in the diaphragm box 14. The respective control rack position and therewith the injection quantities per working or power stroke of the engine and of the torque produced thereby result from the equilibrium of the vacuum force and the positionaldependent spring force.

The variable vacuum required for the control rack displacement is realized in the pressure-transmitter installation 12 of the controller arranged in the path of the air suction line 5. The pressure transmitter device 12 includes in the embodiment illustrated in FIG. 2 a throttle plate 20 axially guided in the air suction pipe 5 by means of the guide rod 18 and exposed to the dynamic pressure of the air suction stream 19; the throttle plate 20 is elastically supported by way of an axially directed spring 21 in such a manner that the spring force is directed opposite to the dynamic pressure. The spring 21 is supported at the axially displaceable spring abutment 24 axially displaceable by the drive lever 10 and the adjusting linkage 23. The throttle plate 20 is so arranged at the end 22 of a suction pipe section that it acts like a valve plate or valve disk acted upon by the flow from below, whereby the end edge 22 of the pipe section forms one boundary edge of the throttle opening and the edge of the movable plate 20 the other edge thereof. Under the assumption of a position of the spring abutment 24 which remains the same, a size of the throttle opening which corresponds to the air-suction velocity, i.e., to the engine rotational speed, will adjust itself automatically owing to the elastic mounting of the throttle plate. With a sufficiently soft characteristic of the spring 21, only a moderate pressure change will establish itself in the interior of the pipe enlargement 25 adjoining the end edge 22. The vacuum which will be established in the pipe enlargement 25 is therefore determined in the first instance by the position of the spring abutment 24 and therewith by the pedal position of the drive pedal 10. Owing to the cone at the spring abutment 24 and to the roller mounted at the linkage end, the drive lever movement is transformed unadulterated into a corresponding axial movement of the spring abutment 24. Two counter-nuts 26 are secured at the end of the guide rod 18 on a thread (not shown). They serve in conjunction with the end face end of the guide sleeve 27 as idling abutment for the throttle plate 20. position The drive lever 10 is displaced by a spring 28 in the direction toward the drive lever position "idling" determined by an abutment (not shown). This spring 28 is constructed and designed considerably more strongly than the spring 21 acting on the adjusting linkage in the opposite direction so that during the automatic return position the adjusting linkage, the spring abutment 24 is displaced toward the left by reason of the spring 28 in the direction toward small throttle cross sections up to the abutment nut 26. By reason of the hindrance or constraint of the axial movement of the throttle plate 20 upon reaching the idling abutment, the spring 21 is increasingly stressed by the further movement of the spring abutment 24. The spring 21 is so constructed and designed that the dynamic pressures occurring with customary idling rotational speeds are no longer able to displace the plate 20 out of the idling positin against the spring prestresses which now establish themselves.

A rigid idling-throttle cross section and therewith correspondingly a steeply decreasing idling characteristic curve would now establish itself without the following measures to be described in detail hereinafter.

This leads under certain circumstances to a periodically fluctuating idling. For purposes of avoiding this, means are provided at the controller which permit the idling characteristic curve to drop off less steeply and which produce a quiet constant idling. In the embodiment according to FIG. 2, for that purpose the throttle plate 20 is coupled elastically yieldingly at the ring-shaped spring abutment 28*a*. The ring 28*a* and the cross traverse 28*b* are retained during idling in the position determined by the abutment nuts 26. The ring 28*a* is held by the retaining pins 29 at a maximum distance to the throttle plate 20 and the throttle plate 20 is prestressed by the idling spring 30 to a predetermined extent against the cross traverse 28*b* to be considered as stationary. The characteristic curve of this spring 30 is steeper than that of the spring 21, however, the prestress of the spring 30 is smaller than the prestress of the spring 21 in the position of the drive lever 10 to "idling". As a result thereof during idling, when by reason of the strong prestress of the spring 21, the spring abutment 28*a* cannot be displaced by the dynamic pressure forces, the plate 20 can still slightly deflect or yield under the dynamic pressure influence thanks to the elastic coupling at the spring abutment 28*a*. In the normal control range, i.e., at higher rotational speeds in which the main spring 21 is not prestressed to the idling value, the prestress is smaller than that of the idling spring 30 so that in the normal control range the elastic coupling of the plate 20 at the ring 28*a* is ineffective; only within the area of the idling rotational speed itself both the main spring 21 as also the idling spring 30 can become effective simultaneously.

The vacuum produced in the pressure transmitter device 12 essentially in dependence on the drive lever position, is conducted by way of the pressure compensating line 31 into the diaphragm box 14 and acts in the described manner on the position of the control rack 13.

A hollow cone-like filler body 34 retained at the walls of the pipe enlargement 25 by way of streamlined arms 33 is mounted in the flow shadow of the throttle plate 20. The filler body 34 forms together with the walls of the pipe enlargement 25 a constriction or enlargement of the flow cross section favorable from a streamlining point of view in the manner of a Venturi-pipe. Owing to the streamlined construction of the cross-sectional constriction and to the arrangement of the connecting place 32 of the pressure compensating line 31 within the area of the narrowest place of this cross-sectional constriction, a quantity-dependent vacuum necessary for the end control is achieved without large flow losses with a completely pushed back throttle plate 20 and with high rates of air flow.

The result of the pneumatic filling or fuel-injection controller according to the present invention is illustrated in FIGS. 4 and 5. The diagram of FIG. 4 thereby reproduces the aimed-at ideal and FIG. 5 the possible realization. The displacement path *s* of the control rack 13, the torque $M_d$ of the engine or the injection quantity *q* of the pump 7 are plotted along the ordinate axes of the diagrams while the rotational speed *n* of the engine is plotted along the abscissae. Lines or curves of identical drive lever position ($\alpha$) are shown in the performance diagram; they extend horizontally in the ideal case (FIG. 4) and are inclined in the real performance diagram (FIG. 5)—due to the unavoidable inclination of a spring characteristic. The idling characteristic line or curve (L) and the end rotational speed characteristic line or curve (E) are in both cases steeply decreasing or dropping off lines which are determined by a constant flow cross section of the flow plate or of the throttle device. The inclined idling characteristic line L′ in the real performance graph comes into existence as a result of the idling increase (idling abutment adapted to be overcome).

Another embodiment of a pressure transmitter unit for a pneumatic filling or injection controller according to the present invention is illustrated in FIG. 3. Insofar as there exists agreement or correspondence in this measuring unit with the unit of FIG. 2, the corresponding parts are designated in FIG. 3 by the same or primed reference numerals, and reference may be had to the preceding description, insofar as necessary, for an understanding thereof.

An eccentrically supported throttle valve or flap 20′ is provided in this embodiment as throttle plate. Owing to the eccentric support of the throttle valve or flap, an always unequivocally directed aerodynamic torque is exerted on the throttle plate by the impact of the air flow. The throttle plate is arranged on the inside of a Venturi pipe 40—which is necessary for the low loss vacuum production within the range of the end rotational speeds. The throttle plate 20′ is retained in this embodiment by two main springs 21′ and 21″ in an elastic equilibrium position dependent on the drive lever position. As a result thereof, the abutment 24′ of the springs can be arranged fixedly. The two springs 21′ and 21″ operate against one another and produce in cooperation a common spring characteristic which corresponds to the addition of the individual spring characteristics. The springs act in the illustrated embodiment on the rope or cable pulley 42 mounted on the throttle plate shaft 41. By a change of the drive lever position in the direction toward larger values $\alpha$, a larger counterforce is applied with respect to the one spring 21′ (stretching of the spring 21″) so that the throttle valve 20′ assumes a new elastically retained equilibrium position. An idling abutment is not provided in this embodiment. The preservation of a minimum cross section with fully retracted drive lever is assured in this case in that the throttle plate 20′ does not completely fill out the narrowest open cross section of the Venturi-insert 40. The idling increase is brought about by an idling valve in the throttle plate. This is produced by a valve plate 43 which covers off idling-openings 44 in the throttle plate 20′ and which is elastically pressed against the downstream side of the throttle plate by an idling spring 30′. The idling spring 30′ is so constructed and designed with respect to spring characteristic and prestress that with a fully transversely extending throttle plate and at idling rotational speeds, at first the idling valve 43 responds before the entire throttle plate 20′ is moved toward the right by the dynamic pressure.

While I have shown and described two embodiments in accordance with the present invention, it is understood that the same is not limited thereto but is susceptible of numerous changes and modifications as known to those skilled in the art, and I therefor do not wish to be limited to the details shown and described herein but intend to cover all such changes and modifications as are encompassed by the scope of the appended claims.

I claim:

1. A pneumatic controller for an injection pump operable to vary the quantity of injected fuel and having a quantity adjusting means, the pneumatic controller comprising a pneumatic actuating means at least indirectly influencing the quantity adjusting means of the injection pump for displacing the quantity adjusting means in case of an actuation with vacuum in a direction toward smaller injection quantities, at least one force storage means for influencing at least indirectly the quantity adjusting means in a direction toward an increase of the injected quantities, and a drive lever means actuatable at will characterized in that means are provided for at least indirectly elastically connecting the drive lever means with the controller, further means are provided in the controller for supplying a correspondingly large vacuum only in accordance with respective deflected positions of the drive lever means, and in that a connection means is arranged between a vacuum connection of said further means and the pneumatic actuating means acting on the quantity adjusting means.

2. A pneumatic controller according to claim 1, characterized in that the connection means arranged between the vacuum connection of said further means and the pneumatic actuating means includes a pressure compensating connection, and in that the injection pump is operable to inject fuel into an internal combustion engine.

3. A pneumatic controller according to claim 2, characterized in that the pneumatic actuating means includes a diaphragm piston means.

4. A controller according to claim 3, characterized in that the force storage means includes spring means.

5. A controller according to claim 2, characterized in that the internal combustion engine is a Diesel internal combustion engine for motor vehicles.

6. A controller according to claim 1, with an air suction line, characterized in that at least the connection means between the vacuum connection of said further means and the pneumatic actuating means is arranged within an area of a cross-sectional constriction of the air suction line which is favorable from a streamlining point of view.

7. A pneumatic controller for an injection pump operable to vary the quantity of injected fuel and having a quantity adjusting means, the pneumatic controller comprising a pneumatic actuating means at least indirectly influencing the quantity adjusting means of the injection pump for displacing the quantity adjusting means in case of an actuation with vacuum in a direction toward smaller injection quantities, a drive lever means actuatable at will and at least indirectly operatively connected with the controller, and an air suction line for an internal combustion engine, characterized in that further means are provided in the controller for supplying a correspondingly large vacuum in accordance with the respective deflected positions of the drive lever means, the further means include a variable throttling means arranged in the air suction line and at least indirectly operatively connected with the drive lever means, said throttling means including a movable throttling part which is so constructed and supported in the throttling means that a force is exerted by a flow passing through the throttling means by reason of a dynamic-pressure-influence in all positions of the movable throttling part which seeks to displace the movable throttling part unequivocally in a direction toward larger opening cross-sections, a force storage means forming a throttle main force storage means is provided for displacing the movable throttling part in a closing direction, said throttle main force storage means is at least indirectly operatively connected with one end thereof with the movable throttling part, the drive lever means is operatively connected with the other end of the throttle main force storage means in such a manner that by a movement of the drive lever means in a direction toward larger power output of the internal combustion engine, the force exerted by the throttle main force storage means on the movable throttling part is reduced and vice versa, and in that a connection means is arranged between a vacuum connection of said further means and the pneumatic actuating means acting on the quantity adjusting means.

8. A controller according to claim 7, characterized in that the movable throttling part includes a throttle plate.

9. A controller according to claim 8, characterized in that the throttle main force storage means includes a spring means.

10. A controller according to claim 9, characterized in that the drive lever means is indirectly connected with the other end of the throttle main force storage means.

11. A controller according to claim 8, characterized in that an adjustable abutment means is provided for effectively limiting movement of the movable throttling part so as to obtain a smallest possible opening cross-section of the throttling means.

12. A controller according to claim 11, characterized in that the abutment means is arranged within a movement range of the throttle plate.

13. A controller according to claim 11, characterized in that the adjustable abutment means is arranged in a movement area of a member kinematically unequivocally coupled with the throttle plate.

14. A controller according to claim 11, characterized in that a spring means is provided for displacing the drive lever means in a direction toward an "idling" position, and in that a return force of said spring means effective at the point of engagement of the connection of the drive lever means with the throttling means is larger than the largest force of the throttle main force storage means.

15. A controller according to claim 14, characterized in that the throttle main force storage means has a relatively flat force/displacement characteristic.

16. A controller according to claim 15, characterized in that a further abutment means is provided, a further force storage means forming a throttle-idling force storage means is arranged in a force transmission between the throttle main force storage means and the throttle plate downstream of the throttle main force storage means, as viewed in the direction of force transmission, in such a manner that the force transmission passes sequentially through the one force storage means and then through the further force storage means, and in that the end of the throttle main force storage means facing the throttle plate cooperates directly with the further abutment means.

17. A controller according to claim 16, characterized in that the further force storage means includes spring means.

18. A controller according to claim 16, characterized in that a part rigidly connected with the throttle main force storage means cooperates directly with the further abutment means.

19. A controller according to claim 18, characterized in that the idling force storage means has a considerably steeper force/displacement characteristic than the throttle main force storage means.

20. A controller according to claim 16, characterized in that the idling force storage means has a considerably steeper force/displacement characteristic than the throttle main force storage means.

21. A controller according to claim 14, characterized in that at least the connection means between the vacuum connection of said further means and the pneumatic actuating means is arranged within an area of a cross-sectional constriction of the air suction line which is favorable from a streamlining point of view.

22. A controller according to claim 21, characterized in that the throttle plate is also arranged within the area of a cross-sectional constriction of the air suction line.

23. A controller according to claim 22, characterized in that the throttle plate is constructed as a plate axially movably supported in the air suction line, in that the air suction line is enlarged within an area of the throttle plate to provide a pipe enlargement, and in that a cone-like filling body extending approximately over the same area as the pipe enlargement is arranged in a flow shadow of the throttle plate and approximately coaxially with the pipe enlargemnt in such a manner that ring-shaped flow cross-sections between filling body and inner wall of the pipe enlargement increases to a normal line cross-section in the flow direction, starting from a minimum value disposed axially approximately at a place of a base of the cone-like filling body.

24. A controller according to claim 23, characterized in that the air suction line is enlarged onion-like.

25. A controller according to claim 11, characterized in that a further abutment means is provided, a further force storage means forming a throttle-idling force storage means is arranged in a force transmission between the throttle main force storage means and the throttle plate downstream of the throttle main force storage means, as viewed in the direction of force transmission, in such a manner that the force transmission passes sequentially through the one force storage means and then through the further force storage means, and in that the end of the throttle main force storage means facing the throttle plate cooperates directly with the further abutment means.

26. A controller according to claim 8, characterized in that a part of the throttle plate is exposed to a dynamic pressure of the air flow, said part of the throttle plate is relatively movably supported with respect to the throttle plate in such a manner that it can be displaced in the direction toward a cross-section enlargement by the dynamic pressure influence, and in that an idling force storage means is arranged between the throttle plate and said last-mentioned part of the throttle plate, said idling force storage means includes a spring means for displacing said last-mentioned part of the throttle plate in a closing direction.

27. A controller according to claim 26, characterized in that said last-mentioned part is an idling plate.

28. A controller according to claim 8, characterized in that a part of the throttle plate is exposed to a dynamic pressure of the air flow, said part of the throttle plate is relatively movably supported with respect to the throttle plate in such a manner that it can be displaced in the direction toward a cross-section enlargement by the dynamic pressure influence, and in that an idling force storage means is arranged between the throttle plate and said last-mentioned part of the throttle plate, said idling force storage means includes a spring means for displacing said last-mentioned part of the throttle plate in a closing direction.

29. A controller according to claim 8, characterized in that the throttle plate is constructed as a plate axially movably supported in the air suction line, in that the air suction line is enlarged within an area of the throttle plate to provide a pipe enlargement, and in that a cone-like filling body extending approximately over the same area as the pipe enlargement is arranged in a flow shadow of the throttle plate and approximately coaxially with the pipe enlargement in such a manner that ring-shaped flow cross-sections between filling body and inner wall of the pipe enlargement increases to a normal line cross-section in the flow direction, starting from a minimum value disposed axially approximately at a place of a base of the cone-like filling body.

30. A controller according to claim 29, characterized in that the air suction line is enlarged onion-like.

31. A controller according to claim 7, characterized in that a spring means is provided for displacing the drive lever means in a direction toward an "idling" position, and in that a return force of said spring means effective at the point of engagement of the connection of the drive lever means with the throttling means is larger than the largest force of the throttle main force storage means.

32. A controller according to claim 7, characterized in that the throttle main force storage means has a relatively flat force/displacement characteristic.

33. A pneumatic controller for an injection pump operable to vary the quantity of injected fuel and having a quantity adjusting means, the pneumatic controller comprising a pneumatic actuating means at least indirectly influencing the quantity adjusting means of the injection pump for displacing the quantity adjusting means in case of an actuation with vacuum in a direction toward smaller injection quantities, at least one force storage means for influencing at least indirectly the quantity adjusting means in a direction toward an increase of the injected quantities, a drive lever means actuatable at will and at least indirectly operatively connected with the controller, the pneumatic controller being arranged in an air suction line for an internal combustion engine, characterized in that the further means include a variable throttling means arranged in the air suction line and at least indirectly operatively connected with the drive lever means, said throttling means including a movable throttling part which is so constructed and supported in the throttling means that a force is exerted by a flow passing through the throttling means by reason of a dynamic-pressure-influence in all positions of the movable throttling part which seeks to displace the movable throttling part unequivocally in a direction toward larger opening cross-sections, a force storage means forming a throttle main force storage means is provided for displacing the movable throttling part in a closing direction, said throttle main force storage means is at least indirectly operatively connected with one end thereof with the movable throttling part, the drive lever means is operatively connected with the other end of the throttle main force storage means in such a manner that by a movement of the drive lever means in a direction toward larger power output of the internal combustion engine, the force exerted by the throttle main force storage means on the movable throttling part is reduced and vice versa, and in that a connection means is arranged between a vacuum connection of said further means and the pneumatic actuating means acting on the quantity adjusting means, at least the connection means between the vacuum connection of said further means and the pneumatic actuating means is arranged within an area of a cross-sectional constriction of the air suction line which is favorable from a streamlining point of view.

34. A controller according to claim 33, characterized in that the movable part is also arranged within the area of a cross-sectional constriction of the air suction line.

* * * * *